US005735496A

United States Patent [19]

Dubé

[11] Patent Number: 5,735,496

[45] Date of Patent: Apr. 7, 1998

[54] RIFLE HARNESS

[76] Inventor: Dorian Dubé, 199 rang Charlotte, St-Liboire, Qc, Canada, J0H 1R0

[21] Appl. No.: 713,476

[22] Filed: Sep. 13, 1996

[51] Int. Cl.[6] ..... B68G 5/00

[52] U.S. Cl. ..... 248/118; 42/94

[58] Field of Search ..... 248/118; 42/94; 224/150, 202–208

[56] References Cited

U.S. PATENT DOCUMENTS

| | | | |
|---|---|---|---|
| 759,593 | 5/1904 | Cover | 42/94 |
| 1,288,684 | 12/1918 | Roe | 42/94 |
| 2,358,551 | 9/1944 | Beaton | 248/118 |
| 3,334,794 | 8/1967 | Saari et al. | 224/150 |
| 3,390,477 | 7/1968 | Galbraith | 248/118 |

*Primary Examiner*—Peter M. Cuomo

*Assistant Examiner*—Gerald Anderson

*Attorney, Agent, or Firm*—Antoine H. Gauvin

[57] ABSTRACT

A rifle harness which comprises a belt, an elbow rest having opposite ends, and a strap having opposite ends. One end of the elbow rest is for receiving an elbow of a human being, or adjacent parts of an upper limb adjacent to the elbow. The other end of the elbow rest, is mounted and adjoining the belt. One of the ends of the strap is mounted to hold the belt, adjacent to one side of the elbow rest. The other end of the strap is mounted to hold the belt, adjacent to a side opposite the one side of the elbow rest. Thus the strap is for running from one of the ends holding the belt, for diagonally crossing up the back of that human being, running over the shoulder joining the other upper limb, and diagonally crossing down the thorax, to finally hold the belt, adjacent to a side opposite the one side of the elbow rest. With this harness, shooting is more reliable.

20 Claims, 2 Drawing Sheets

RIFLE HARNESS

BACKGROUND OF THE INVENTION

1. Field of the Invention

This invention relates to a rifle harness.

This invention relates in particular to such a harness for hunting, being particularly useful for bull's eye shots.

2. Description of Related Art

As far as Applicant is aware, there is no known rifle harness, and particularly no such a harness for hunting.

BRIEF SUMMARY OF THE INVENTION

The aim of this invention is to have an elbow rest to aim straight at a given target harness by resting the elbow of a human being, bearing the rifle, or adjacent parts of an upper limb adjacent to that elbow.

In a preferred embodiment, the invention aims at having a light elbow rest.

Broadly stated the invention is directed to a rifle harness for a human being, said human being having opposite upper limbs, comprising:

a belt, an elbow rest having opposite ends, one end of said elbow rest, for receiving an elbow of a human being from one of said upper limbs, and adjacent parts of said one upper limb adjacent to said elbow, and the other end of said elbow rest, adjoining said belt, a strap having opposite ends, one of said ends of said strap, being mounted to hold said belt, adjacent to one side of said elbow rest, and the other of said ends of said strap being mounted to hold said belt, adjacent to a side opposite said one side of said elbow rest, whereby said strap is for running from said one of said ends holding said belt, diagonally crossing up the back of said human being, running over the shoulder joining the other upper limb and diagonally crossing down the thorax, for finally holding said belt, at said adjacent to a side opposite said one side of said elbow rest.

Further embodiments of the invention will be described herein below.

DESCRIPTION OF THE DRAWINGS

In the drawings which illustrate some of the preferred ways of carrying out the invention.

DETAILED DESCRIPTION

Figures 1, 2, 3, 4, 5, 8:
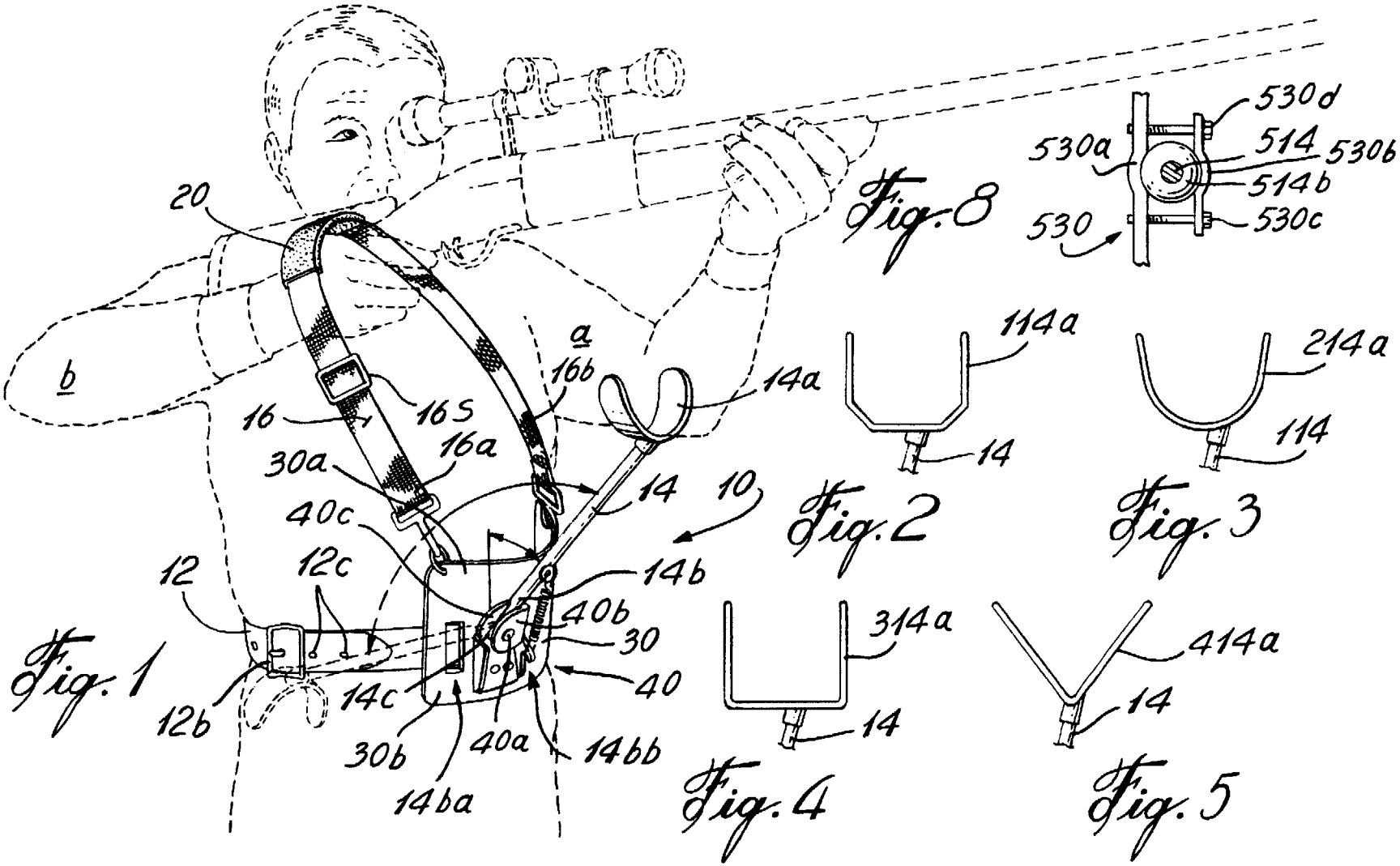
FIG. 1 is a perspective view of a rifle harness mounted over an outlined human being carrying an outlined rifle, outlined being made for sake of clarity.
FIG. 2 is a face view of the one end of an elbow rest, for receiving an elbow of a human being.
FIG. 3 is a face view of the one end of another elbow rest, for receiving an elbow of a human being.
FIG. 4 is a face view of the one end of another elbow rest, for receiving an elbow of a human being.
FIG. 5 is a face view of the one end of still another elbow rest, for receiving an elbow of a human being.
FIG. 8 is a top view illustrating the other end of an elbow rest ending into a ball-and-socket joint onto a linking piece.

As shown in FIG. 1, a rifle harness 10 for a human being, said human being having opposite upper limbs a and b, comprises:

a belt 12, an elbow rest 14 having opposite ends 14*a*, 14*b*, one end of said elbow rest, such as 14*a*, for receiving an elbow of a human being from one of said upper limbs, such as a, and adjacent parts of said one upper limb adjacent to said elbow, and the other end of said elbow rest, such as 14*b*, adjoining the belt 12.

A strap 16 having opposite ends 16*a*, 16*b*, holds the belt 12, and thereby the elbow rest 14:

one of the ends of the strap 16, such as 16*a*, is mounted, for instance fixably or removably, to hold the belt 12, adjacent to one side of the elbow rest, such as 14*ba*, riveted, fixed or releasable and the other of said ends of the strap, such as 16*b*, is fixably or removably mounted to hold the belt 12, adjacent to a side opposite said one side of the elbow rest, such as 14*bb*, whereby the strap is for running from the one of the ends holding the belt, diagonally crossing up the back of the human being, running over the shoulder joining the other upper limb and diagonally crossing down the thorax, for finally holding the belt, at the adjacent to a side opposite the one side of the elbow rest.

Figure 6:
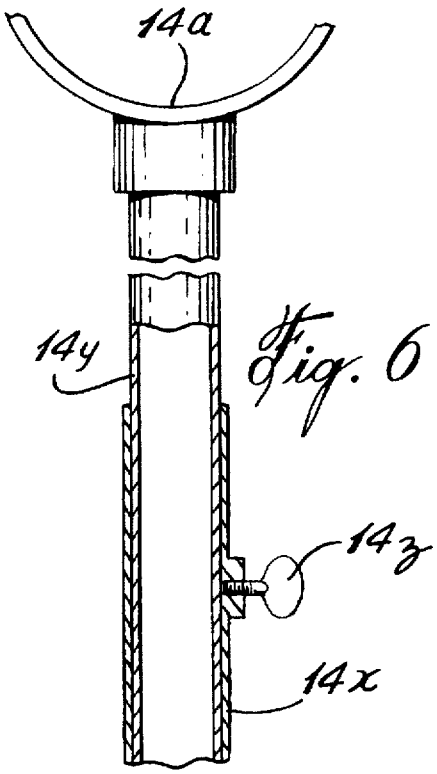
FIG. 6 is a face view, partly in cross-section, of a portion of an adjustable elbow rest illustrating the junction of two members telescopically mounted, and one of the means to releasably hold the two members together for adjustment.
Figure 6A:
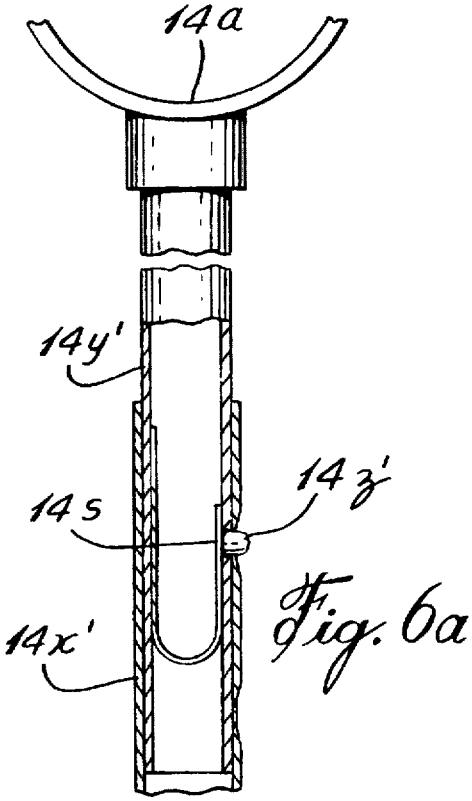
FIG. 6*a* is a face view, partly in cross-section, of a portion of another adjustable elbow rest illustrating the junction of two members telescopically mounted, and another means to releasably hold the two members together for adjustment.
Figure 7:
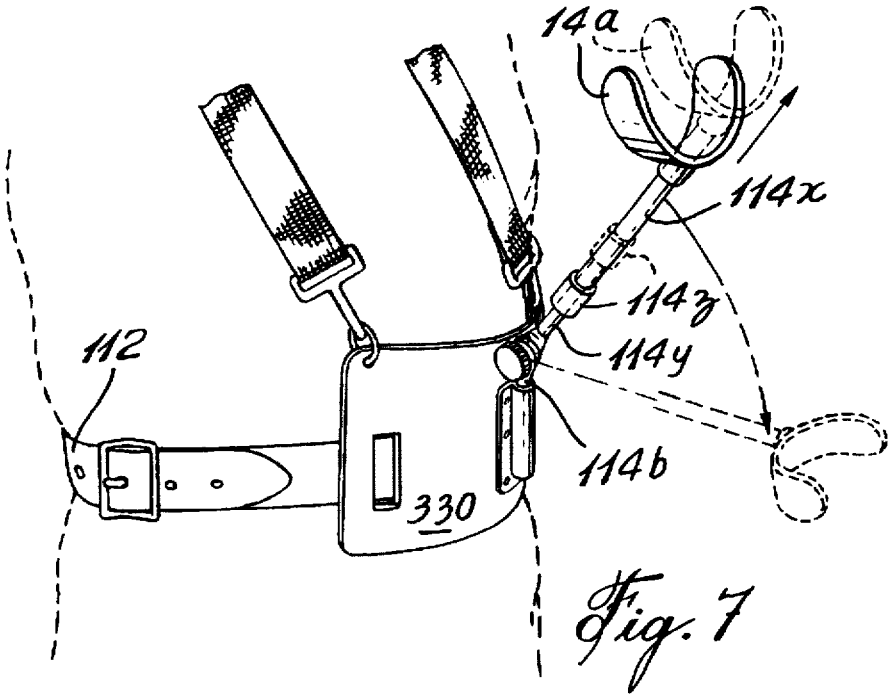
FIG. 7 is a perspective view illustrating the other end of another elbow rest, via a linking piece fixably mounted unto a belt.

Preferably, the elbow rest is adjustable, a convenient way is a telescopic elbow rest: For example as shown in FIG. 6, with two tubular members such as 14*x*, 14*y*; one such as 14*y*, sliding over the other such as 14*x*. The telescopic elbow rest is also provided with a means for releasably holding the tubular member to a given position, for instance a screw 14*z* threadedly mounted on the tubular member 14*x* for frictionally engaging and holding the tubular member 14*y*, or as shown in FIG. 6*a*, a spring (14*s*) loaded pin 14*z*' mounted on or in the tubular member, 14*y*' for instance, and engaging the other tubular member 14*x*' provided with slots, along one of the slots, as shown in FIG. 6*a* or vice versa; or as shown in FIG. 7, with a tightening ring 114*z* having a tapering end and threadedly mounted over a tubular member 114*x* for squeezing a tubular member 114*y*. The elbow rest needs not be adjustable, and may simply be an arm ending into one end for receiving an elbow and the one end for receiving an elbow may even be integral with that arm.

The one of the elbow rest, for receiving an elbow may have various shapes, for instance but without being limited thereto, that one end may be polygonal with at least one of the sides removed as shown at 114*a*, FIG. 2, oval shape partly cut out as shown at 214a, FIG. 3, rectangular with one of the sides removed as shown at 314a, FIG. 4, triangular with one of the sides removed as shown at 414, FIG. 5, and preferably is C-shaped as shown at 14a, FIG. 1.

Preferably, the belt is an adjustable belt, either with a belt buckle having a tongue 12b and a belt doweled such as 12c, with or without an adjustment slide, or a belt buckle having therein an adjustment slide or even a safety seat belt type.

Preferably, the strap 16 having opposite ends, is adjustable, for instance with an adjustment slide, for instance as shown at 16s, or with other adjustment devices including the adjustment devices discussed herein above for the belt.

Preferably, the strap 16, having opposite ends, includes a weight distribution rider, for instance as shown at 20, slidably mounted onto the strap. The strap 16 and/or the weight distribution rider, may also be padded if desired.

In a preferred embodiment the weight distribution rider such as 20, has an anti-skid surface such as shown at 20, for better adherence of the strap with the cloth over the shoulder of human being wearing the harness.

The linking piece

Preferably, the rifle harness includes a linking piece, for instance 30, the other end of the elbow rest, such as 14b, being mounted rotatably adjustable to the linking piece, for instance 30, that linking piece being mounted to the belt, such as 12.

Figure 7A:
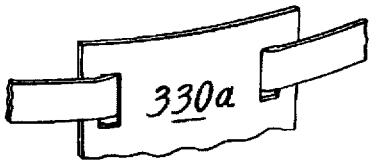
FIG. 7*a* is a perspective view illustrating a portion of the linking piece of FIG. 7 but slidably mounted to a belt, via a linking piece.

The linking piece may be fixably mounted to the belt as shown at 330 FIG. 7, and 30 FIG. 1, or be slidably mounted as shown in FIG. 7a at 330a, so that said other end of said elbow rest, is adjoining said belt via said linking piece.

In a preferred embodiment as shown in FIG. 1, the linking piece defines an upper portion 30a and a lower portion 30b, the other end of the elbow rest, 14b, is rotatably mounted to the lower portion 30b of the linking piece so as to be rotatably adjustable with respect to the linking piece, the lower portion of the linking piece being fixably or preferably slidably mounted to the belt, and the ends of the strap 16 being mounted to the upper portion such as 30a of the linking piece. The linking piece may be fixably mounted to the belt, for instance with rivets or other fasteners.

Preferably,the other end of the elbow rest 14b, is mounted and adjoining the belt, as to be inclined, so that the elbow rest, gradually moves away from the linking piece, from the lower portion such as 30b to the upper portion of the linking piece such as 30a. In a particular embodiment, the elbow rest defines an angle of 45° ±20° with the linking piece.

Preferably, the ends of the strap such as 16a, 16b, are releasably mounted to the upper portion 30a of the linking piece 30. Thus the plate 30 is urged against the human being, by the pulling action of the belt 12 on the lower portion 30b, and of the strap 16 on the upper portion 30a.

In a preferred embodiment, as shown in FIG. 1, the linking piece 30 is a curved, and yielding stiff plate: the curve fitting at least somewhat the shape of a human being, and yielding somewhat as to prevent body injuries. This linking plate may be plastic made but is not limited thereto.

The other end of the elbow rest

As shown in FIG. 1, the other end of the elbow rest such as 14b, is mounted and adjoining the belt via a swivel 40:

the other end of the elbow rest has a perforation 14c, the swivel 40 having a pair of retaining walls 40b, 40c spaced one from the other, and a shaft or pivot 40a bridging said pair of retaining walls, whereby the other end 14b of the elbow 14, is held between the retaining walls 40b, 40c, of the swivel and the shaft or pivot 40a is engaging the perforation of the other end of the elbow rest. This allows a human being to bend over, by displacing the one end of the elbow rest from an upward to a horizontal position, as shown in FIG. 1:

For instance as shown in FIG. 1, the rifle harness the pair of retaining walls 40b, 40c spaced one from the other wall, are fixedly held together as to define a C-shaped cross-section, and the elbow rest is spring loaded to move from a substantially upward to a substantially horizontal position as shown to allow a human being to bend over.

Although as shown in FIG. 1, the pair of retaining walls spaced one from the other walls, are fixedly held together as to define a C-shaped cross-section, in another embodiment, the retaining walls 40a and 40b may be separated and the shaft or pivot 40a of the swivel, may have a free threaded end, for receiving a nut to move one of the retaining walls 40a and 40b to and fro said other of the retaining walls, and thereby to releasably hold the other end of the elbow rest between the retaining walls.

In a preferred embodiment, these retaining walls 40a, 40b have internal teeth lock.

In another embodiment, at least one of these retaining walls 40a, 40b has internal teeth lock, and said other end of said elbow rest between said retaining walls, has also internal teeth lock for engaging with the internal teeth lock of said at least one retaining wall.

As shown in FIG. 8, in another embodiment, the elbow rest 514 has the other end 514b ball shaped, as to be rotatably mounted and be rotatably adjustable. For instance, the other end 514b is mounted and adjoining the belt via a ball-and-socket joint. The socket for instance having a pair of jaws: a first hemispheric jaw 530a having a cut out top segment, defined within a linking piece 530 and a second hemispheric jaw 530b having a cut out top segment, slidably mounted about screws 530c and 530d releasably holding the pair of jaws 530a, 530b, so as to move to and fro each other and thereby said ball-shaped end 514b, to releasably hold the ball-shaped end 514b with the socket 514a and 514b. The screws 530c and 530d may for instance be threaded female portions provided for, in one of the linking piece 530, Such as shown in 530a or be of the nut-and-bolt type.

It should be borne in mind that the belt, the strap and the elbow rest need not be adjustable, as they may be made to measure for a given human being, or made for human beings of a given size. If desired, though less preferred, the other end of the elbow rest may also be fixedly mounted.

While some of the preferred embodiments have been described herein above, it is to be understood that the invention is not to be construed as limited to these preferred embodiments, as many modifications and variations are possible within the spirit and scope of the appended claims.

I claim:

1. A rifle harness for a human being, said human being having opposite upper limbs, comprising:

a belt, an elbow rest having opposite ends, one end of said elbow rest, for receiving an elbow of a human being from one of said upper limbs, and adjacent parts of said one upper limb adjacent to said elbow, and the other end of said elbow rest, adjoining said belt, a strap having opposite ends, one of said ends of said strap being mounted to hold said belt, adjacent to one side of said elbow rest, and the other of said ends of said strap being mounted to hold said belt, adjacent to a side opposite said one side of said elbow rest, whereby said strap is for running from said one of said ends holding said belt, diagonally crossing up the back of said human being, running over the shoulder joining the other upper limb and diagonally crossing down the thorax, for finally holding said belt, at said adjacent to a side opposite said one side of said elbow rest.

2. The rifle harness as defined in claim 1, wherein said elbow rest is telescopic.

3. The rifle harness as defined in claim 1, which includes a linking piece, said other end of said elbow rest, being mounted rotatably adjustable to said linking piece, said linking piece being fixably mounted to said belt, so that said other end of said elbow rest, is adjoining said belt via said linking piece.

4. The rifle harness as defined in claim 1, which includes a linking piece, said other end of said elbow rest, being mounted rotatably adjustable to said linking piece, said linking piece being slidably mounted onto said belt, so that said other end of said elbow rest, is adjoining said belt via said linking piece.

5. The rifle harness as defined in claim 1, wherein said one end of said elbow rest, for receiving an elbow is C-shaped.

6. The rifle harness as defined in claim 1, which includes a linking piece defining an upper portion and a lower portion, said other end of said elbow rest, being rotatably mounted to said lower portion of said linking piece, so as to be rotatably adjustable with respect to the linking piece, said lower portion of the linking piece being mounted to said belt, and said ends of said strap being mounted to said upper portion of said linking piece.

7. The rifle harness as defined in claim 6, wherein said other end of said elbow rest, is adjoining said belt as to be inclined, so that the elbow rest, gradually moves away from said linking piece, from said lower portion to said upper portion of said linking piece.

8. The rifle harness as defined in claim 6, wherein said elbow rest defines an angle of 45°±20° with the linking piece.

9. The rifle harness as defined in claim 6, wherein said ends of said strap are releasably mounted to said upper portion of said linking piece.

10. The rifle harness as defined in claim 6, wherein said linking piece is a curved, yielding stiff plate.

11. The rifle harness as defined in claim 1, wherein said other end of said elbow rest is mounted and adjoining said belt via a swivel:

said other end of said elbow rest has a perforation, said swivel having a pair of retaining walls spaced one from the other and a pivot bridging said pair of retaining walls, whereby said other end of said elbow is held between said retaining walls of said swivel, and the pivot is engaging said perforation of said other end of the elbow rest.

12. The rifle harness as defined in claim 11, wherein said retaining walls are separated one from the other, and the pivot of said swivel, has a free threaded end for receiving a nut to move one of said retaining walls to and fro said other of said retaining walls, and thereby to releasably hold said other end of said elbow rest between said retaining walls.

13. The rifle harness as defined in claim 12, wherein one of said retaining walls has internal teeth lock.

14. The rifle harness as defined in claim 12, wherein said other of said retaining walls has internal teeth lock and said other end of said elbow rest between said retaining walls, has internal teeth lock for engaging with the internal teeth lock of said other of said retaining walls.

15. The rifle harness as defined in claim 12, wherein said pair of retaining walls spaced one from the other wall, are fixedly held together as to define a C-shaped cross-section, and the elbow rest is spring loaded to move from a substantially upward to a substantially horizontal position.

16. The rifle harness as defined in claim 11, wherein said other end of said elbow rest is fixedly held.

17. The rifle harness as defined in claim 1, wherein said strap having opposite ends, is adjustable.

18. The rifle harness as defined in claim 1, wherein said strap having opposite ends, includes a weight distribution rider slidably mounted onto said strap.

19. The rifle harness as defined in claim 1, wherein said other end of said elbow rest is adjoining said belt via a ball-and-socket joint:

said other end of said elbow rest being ball shaped, as to define said ball of said ball-and-socket joint, said socket having a pair of movable jaws to move to and fro said ball, in order to releasable hold said ball shaped end of said elbow rest, for adjustment.

20. The rifle harness as defined in claim 1, wherein said belt is adjustable.

* * * * *